United States Patent [19]

Spilka

[11] Patent Number: 4,629,152

[45] Date of Patent: Dec. 16, 1986

[54] HOLDING FIXTURE FOR RELEASABLY CONNECTING AT LEAST TWO WALL ELEMENTS

[76] Inventor: Heinrich Spilka, Schlosshoferstrasse 32, 2301 Grossenzersdorf, Austria

[21] Appl. No.: 697,587

[22] PCT Filed: May 11, 1984

[86] PCT No.: PCT/AT84/00017

§ 371 Date: Jan. 7, 1985

§ 102(e) Date: Jan. 7, 1985

[87] PCT Pub. No.: WO84/04446

PCT Pub. Date: Nov. 22, 1984

[30] Foreign Application Priority Data

May 13, 1983 [AT] Austria ..... 1756/83

[51] Int. Cl.[4] ..... A47F 7/14

[52] U.S. Cl. ..... 248/488; 40/155; 248/490

[58] Field of Search ..... 248/480, 475.1, 476, 248/488, 490; 24/326, 335, 67 CF, 458; 40/155

[56] References Cited

U.S. PATENT DOCUMENTS

| | | | |
|---|---|---|---|
| 1,618,985 | 3/1927 | Kelly et al. | 248/480 |
| 2,914,829 | 12/1959 | Willemain | 248/480 X |
| 3,360,228 | 12/1967 | Murdoch | 248/480 |
| 3,750,314 | 8/1973 | Crawford | 248/475.1 X |
| 4,204,350 | 5/1980 | Brenner | 40/155 |
| 4,473,207 | 9/1984 | Nascher | 248/488 X |

*Primary Examiner*—Ramon O. Ramirez
*Attorney, Agent, or Firm*—Werner W. Kleeman

[57] ABSTRACT

The invention relates to a holding fixture for releasably connecting at least two wall elements and comprising holding clamps which grippingly extend around the margins of at least one rear wall element and a front wall element arranged substantially parallel thereto and which are releasably connectable to the rear wall element. In order to enable simple and economic assembly of such elements of the most various types like, for example, picture glass with picture rear walls, there are provided holding clamps which at least partially engage the rear side of the rear wall element (4) and which are substantially force-lockingly connectable to the rear wall element (4), traversing holding pins containing a bearing member (31) engageable to the front side of the rear wall element (4), a through-pass member (32) which extends away therefrom substantially at right angles and which traverses the related opening (41) in the rear wall element (4) and a holding member (33) following the same and protruding above the rear side of the rear wall element (4).

24 Claims, 6 Drawing Figures

HOLDING FIXTURE FOR RELEASABLY CONNECTING AT LEAST TWO WALL ELEMENTS

BACKGROUND OF THE INVENTION

The present invention relates to a new and improved holding fixture for releasably connecting at least two wall elements.

In its more particular aspects, the present invention more specifically relates to a new and improved holding fixture for releasably connecting at least two wall elements and comprising a predetermined number of holding clamps. The two wall elements constitute, for example, a front wall element and a rear wall element. The front wall element is arranged substantially parallel to the rear wall element and is releasably connectable to the rear wall element by means of the predetermined number of holding clamps which grippingly extend around the margins of the rear wall element.

Presently there exists in a great number of instances the problem of connecting a substantially flat rear wall which has a load-carrying function and which can be connected, for example, by hanging the same on, for instance, a support structure, with a decorative, protective, reflecting and the like front wall in an inconspicuous and, if possible, attractive and slip-proof manner. As an example there are mentioned displaceable walls, panels, elements or the like for use in exhibitions, fairs, presentations or the like, cover elements, decoration elements and heat-insulating elements which are used in architecture and construction engineering. The invention is directed in particular to a holding fixture for pictures, maps, display objects or the like which are intended to be mounted, for example, on walls, or for objects containing a reinforcing rear wall, for example, for holding the glass of pictures which can be uprightly positioned, or the like. The invention furthermore relates to, for example, mirrors and the like. In the last mentioned cases there is thus provided a transparent or light-reflecting front wall which offers an unhindered view.

A great number of holding fixtures are in use for architectural purposes and for purposes related to the techniques of presentation and in most of the known holding fixtures complicated constructions are provided for interconnecting the front wall and the rear wall. There have become known, for example, frame means for pictures, decorative plates etc. and which frame means all have in common that they are mostly releasably connected to a reinforcing rear wall by means of their parts which serve for mounting purposes. The frame means are designed such that they grippingly extend approximately in the manner of claws around the margins of the supporting rear wall, a possibly present picture support, the display object and the front glass or decorative front plate. There are thus known, for example, constructions in which the holding clamps are interconnected on the rear side of the (picture) rear wall by means of cords, wires, springs or metal or plastic bars, whereby an adaptation to different sizes of the wall element can be made, however, only within certain limits. There are further known mountable holding clamps which can be mounted independently of each other and which are to be connected to the picture rear wall by the most various means, for example, by snap-fit connections or by spikes which must be stuck into the rear wall. Finally, a generally used mounting system should not remain unmentioned, wherein slot grooves are machined into a picture rear wall on the rear side thereof. The slot grooves are outwardly deepened at an inclination and extend parallel to the picture margins, and resiliently biased holding clamps with correspondingly inclined bent-off extensions engage with the slot grooves.

Disadvantages of these systems which have become known hitherto, are their relative elaborate construction, expensiveness and complexity during assembly. In the case of larger-size objects there also exists the danger of a release of the clamps from the picture rear wall due to the deformation of, for example, the clamps, the aforementioned spikes or the extensions at the holding clamps which are in engagement with the groove. Such deformation occurs as a result of the continuous action of the inherent weight. In the last-mentioned system there exists the danger, when using the generally employed rear wall materials, for example, strong cardboards, fiber boards or the like that the grooves in the rear wall are damaged after a number of front changes and that then there is no longer ensured positive holding of the front wall element, hence for example the glass.

SUMMARY OF THE INVENTION

Therefore, with the foregoing in mind, it is a primary object of the present invention to provide a new and improved construction of a holding fixture for releasably connecting at least two wall elements and which is not afflicted with the drawbacks and limitations of the prior art constructions heretofore discussed.

Another significant object of the present invention is directed to a new and improved construction of a holding fixture for releasably connecting at least two wall elements and which enables simple assembly of the at least two wall elements as well as a simple change of the front wall element or the object arranged on the rear thereof in such a manner that such changes can also be made by laymen.

A further important object of the present invention aims at the provision of a new and improved construction of a holding fixture for releasably connecting at least two wall elements and which, despite its simple structure, enables safe and precise mounting of the front wall element and hanging of the entire assembly.

Now in order to implement these and still further objects of the invention which will become more readily apparent as the description proceeds, the holding fixture of the present development is manifested by the features that, the holding clamps at least partially engage the rear side of the rear wall element and are substantially force-lockingly connectable to the rear wall element by means of holding pins. Each of the holding pins traverses at least one related opening in the rear wall element and contains a bearing member which is engageable to the front side of the rear wall element. The holding clamps are further connectable to the rear wall element by means of a through-pass member which extends substantially at right angles from the bearing member and which traverses the related opening in the rear wall element, and by means of a holding member which follows the through-pass member and protrudes over the rear side of the rear wall element.

The inventive holding fixture achieves its easy-to-mount characteristic and high holding and hanging reliability due to the fact that a through-pass opening is provided at a predetermined location in the rear wall through which the holding pin is passed through, which either due to its structure or by means of a special mounting member accomplishes the connection to the holding clamp. In this manner there is avoided any adhesive, nail-type or threaded connection or the like or the anchoring thereof in the mostly relatively thin-walled rear wall in order to connect the same with the front wall holding clamps.

Particular reliability is realized in an advantageous design of the novel holding fixture in which the holding member of the holding pin comprises a form-locking element which cooperates while forming a force-locking connection with a form-locking counter element of a separate connecting piece or with the holding clamp as such.

Preferred designs of holding pins with form-locking connection elements comprise, for example, a thread at the holding member and a nut as the connecting piece or snap-fastener connection between the holding member and a connecting piece which is designed as a snap-fastener.

Simple assembly with a most simple design of the holding pin is realized when the holding member of the holding pin comprises a holding element which can be passed through the opening in the rear wall element during the assembly and which grippingly extends over the holding clamp in the assembled state. The holding pin which, for example, may be made of plastic, carries at the top a holding member which broadens and enlarges only after passage through the through-pass opening of the rear wall and blocks in the opposite direction, for example, in the manner of an unbrella. Such holding pin can be readily replaced by a new one in the event of picture change or the like.

A particularly preferred, simple embodiment of the invention is characterized in that the holding member of the holding pin is formed by a flexible extension of the through-pass member, which extension can be bent across the holding clamp and cooperates at that location, if desired, with a position securing element. With respect to the holding pin in the last-mentioned design it may be mentioned that this holding pin in its final assembled state is designed with steps in a most favorable way such that its bearing member and its bent-over holding member extend in opposite directions with respect to each other and relative to the through-pass member which is arranged substantially at right angles relative to the two mentioned members. There is thus ensured in the assembled state a full engagement of the preferably flat bearing member with the front side of the picture rear wall such that there is prevented to the greatest extent a troublesome "through-pressing" of the bearing member, for example, through a mounted picture. Solely the weight of the wall elements exerts a sufficiently strong force at the rear wall such that there is safely prevented a bending open of the elongate holding member which is present between the rear side of the rear wall and the supporting structure, the wall of a room or the like. The aforementioned protective element may constitute, for example, a protruding strap of the clamp under which the extended holding member can be pushed in order to obtain safety against bending open and rotation.

When, as further advantageously intended, in the region of the opening in the rear wall element for the through-pass member a recess is arranged for receiving the bearing member of the holding pin, it need not be feared that the display object is impaired, for example, due to pressing through or the like which is particularly important for the mounting of a picture.

When, as furthermore and advantageously intended, the bearing member comprises a spacing member extending towards the front wall element, a distance can be maintained between the front wall and the rear wall, for example, for placing insulating materials for construction components or when a display object comprising elevations must be placed between a front glass and the rear wall.

In order to enable a mounting which is insensitive to unevenness of the wall and which ensures a spacing with respect to the support structure, the wall of a room or the like and also rear side ventilation, the holding clamp in accordance with a further advantageous embodiment comprises at least one raised picture hanging region spaced from the rear side of the rear wall and with a hang-on aperture with an outer boundary edge preferably extending substantially parallel to the respective picture margin.

When, as preferred, the outwardly directed boundary edge of the aforementioned hang-on aperture is arranged in a an edge-parallel manner, any positionally imprecise arrangement of hanging-on wall hooks can be compensated for and a parallel displacement of the wall elements into a desired position can be effected. However, there can be arranged one or more recesses, for example, in a saw-tooth manner, at the aforementioned edge and there can thus be effected a locking-type of engagement of hang-on pins with the recesses and thus a mounting which is more stable against displacement.

The holding pins advantageously are made of tension-proof, if desired, resilient material, preferably of plastics or of metal, like steel, brass, aluminum or the like. It can also be advantageous when the bearing member and the through-pass member are resiliently connected, whereby a full engagement of the bearing member at the front side of the rear wall is obtained even if the opening in the rear wall is not bored exactly normally to the surfaces and in the direction of the bearing member and the through-pass member.

The holding pin as such, specifically the through-pass member thereof, advantageously is formed with a circular cross-section, whereby the most simple type of opening in the rear wall is made possible in the form of a conventional bore. When the pin is of flat or cornered structure, protection against rotation is achieved in the presence of a then advantageously cornered or slit-like rear wall opening.

The holding clamp can be manufactured in the most simple manner and has only small material thickness when the holding clamp is made, for example, of aluminum or steel sheet material and is formed in one piece with the claws which grippingly extend across the margin for holding the front wall and with the eventual spacing elevation. The holding clamp then can be simply punched and, if desired, shaped during the same working step. The holding clamps may also be manufactured from, if desired, transparent plastic, whereby the transparent plastic renders the holding claws on the front wall inconspicuous.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
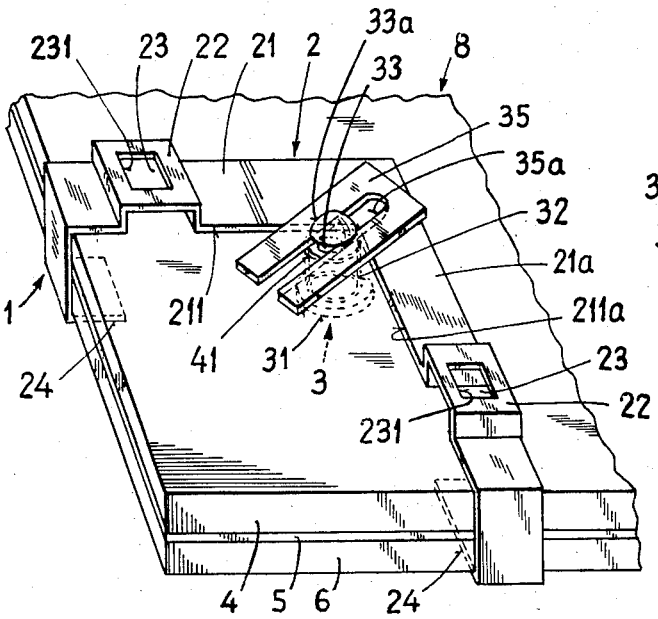
FIG. 1 is a perspective view of a first embodiment of the inventive holding fixture shown in combination with a corner region of a rear wall element and a front wall element.

Describing now the drawings, it is to be understood that only enough of the construction of the holding fixture has been shown as needed for those skilled in the art to readily understand the underlying principles and concepts of the present development, while simplifying the showing of the drawings. Turning attention now specifically to FIG. 1 of the drawings, there has been shown in a perspective view a first exemplary embodiment of the inventive holding fixture 1. This holding fixture 1 is present on the rear side of a corner region of a combination 8 of a rear wall element 4, an intermediate layer 5 which, for example, forms a display object, and a front wall 6. This holding fixture 1 contains a holding clamp 2 comprising two legs 21 and 21*a* and leg end regions comprising claw-like holding projections 24 which grippingly extend around the margins of the rear wall element 4, an intermediate element 5, for example, the display object as well as the front wall element 6 which, for example, may be made of glass.

Adjacent the intercrossing of two inner edges 211, 211*a* of the legs 21 and 21*a* of the holding clamp 2 an opening 41 is provided in the rear wall element 4. The opening 41 is traversed by a through-pass member 32 of a holding pin 3 comprising a flat-designed bearing member 31 which is here shown in broken lines and bears upon the front side of the rear wall element 4. The holding pin 3 further comprises a holding member 33 with a mushroom-like enlarged end or enlargement 33*a* constituting a securing element and comprises protrudes above the angled region of the holding clamp 2, which angled region engages the rear side of the rear wall element 4. The throat below the enlargement 33*a* of the holding member 33 is substantially form-lockingly embraced by a mounting piece 35 which comprises a slot-like cut-out 35*a*. The enlargement 33*a* with its bottom side thus bears upon the mounting piece 35 which, in turn, after its insertion under the enlargement 33*a* has been effected, urges by means of its bottom side the holding clamp 2 in its corner region against the rear side of the rear wall element 4. When the illustrated mounting piece 35 is of a flat wedge-shape, a particularly firm hang-on holding fixture can be obtained.

In order to enable lateral positionally exact hang-on of the flat combination 8, which may include, for example, a picture as the intermediate element 5, at a distance from a supporting wall, the illustrated embodiment of the holding clamp 2 is provided with two raised spacing regions 22 which are arranged in a spaced relationship from the rear wall element 4 and which have hang-on apertures 23 bounded by edge portions 231 extending parallel to the margins or edges of the wall elements 4 and 6.

The illustrated angled design of the holding clamp 2 renders possible, by a simple assembly operation which also substantially facilitates a desired front wall change or a picture change and the like. This angled structure of the holding clamp 2 also enables a particularly efficient connection to the rear wall element 4 and thus ensures full engagement with the front wall element 6 which may constitute, for example, a glass pane and with an intermediate layer 5 like, for example, a picture and thereby yields a slip-proof connection. For small and medium sizes of the wall element 4, 5 and 6 a length of 5 and 10 cm is preferred for the legs 21 and 21*a* of the holding clamp 2 in the form as shown.

It is herein still further mentioned that substantially single-leg holding clamps which are particularly intended for a full inter-engagement of the wall elements 4, 5, 6 in the central region of specifically the edges of a picture and which must be mounted outside the intersection ranges of the wall element edges, are also subject of the present invention. Such single-leg holding clamps advantageously comprise an opening which can be brought into alignment with the pin through-pass opening in the rear wall element 4 of, for example, the picture. In such arrangement, the through-pass member of the afore-described holding pin traverses both of the openings and the holding member presses, while being in force-locking connection with the separate mounting piece, the leg of holding clamp against the rear side of the wall element 4.

Figure 2:
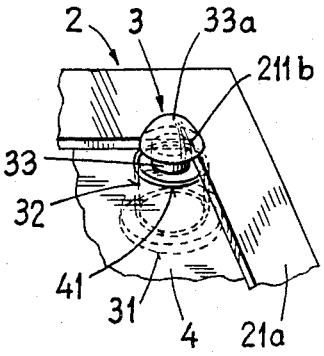
FIG. 2 is a perspective partial view of a second embodiment of the inventive holding fixture.

A part of a second exemplary embodiment of the inventive holding fixture is illustrated in FIG. 2 in oblique elevation. There are visible in FIG. 2 bearing member 31, a through-pass member 32 traversing an opening 41 in a rear wall element 4 and a holding member 33. The holding member 33 comprises an enlarged end or enlargement 33*a*, constituting a securing element and forms part of a holding pin 3. A separate mounting piece like the mounting piece 35 illustrated in FIG. 1 can then be omitted without problems in the case of for instance lighter-weight panels, pictures or the like. It is only important in this second embodiment of the inventive holding fixture that the bottom side of the enlargement 33*a* after its thorough-passage grippingly extends over the inner edges 211 and 211*a* of the holding clamp legs 21 at the intersection or merger location 211*b* which is substantially aligned to the pin through-pass opening 41 in the rear wall element 4. In this region the holding clamp 2 is engaged by the rear side of the enlargement 33*a*. During the mounting of the wall elements 4, 5 and 6 like, for example, during hanging on a picture, there is effected, due to the inherent weight, a fully engaging cooperation of the holding clamp 2 as such with the throat formed by the holding member 33 and the enlargement 33*a* thereof.

Figure 3:
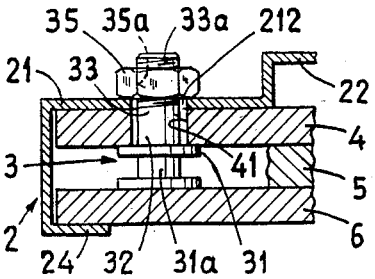
FIG. 3 is a sectional partial view of a third embodiment of the inventive holding fixture.
Figure 4:
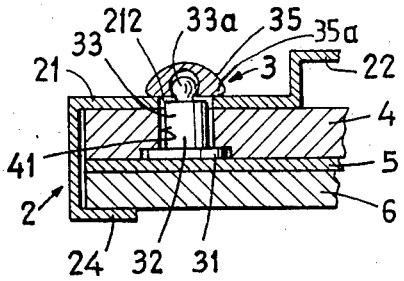
FIG. 4 is a sectional partial view of a fourth embodiment of the inventive holding fixture.

FIGS. 3 and 4 reprectively show in section a third and fourth exemplary embodiment of the inventive holding fixture 1 containing a holding clamp 2 with a spacing elevation 22. Otherwise the holding clamp 2 bears upon the rear side of the rear wall element 4. A claw 24 of the holding clamp 2 grippingly extends around the margin of the front wall element 6, an intermediate element 5 which may constitute, for example, a picture, an intermediate space 5 filled by, for example, a flat three dimensional display object or a heat insulating material, as well as a rear wall element 4 which extends parallel thereto. A holding pin 3 engages the front side of the rear wall element 4 by means of its bearing member 31, traverses an opening 41 of the rear wall element 4 and an aperture 212 in the holding clamp 2 by means of its through-pass member 32 and protrudes above the holding clamp 2 by means of its holding member 33 with a form-locking securing element.

In the third embodiment shown in FIG. 3 the leg 21 of the holding clamp 2 is secured by securing means or elements constituting a nut 35 with a counter-thread 35*a* and a thread member 33*a* of the holding member 33 which is form-lockingly connected with the counter-thread 35*a* of the nut 35. These form-locking securing elements produce a force-locking connection between the holding clamp 2 and the rear wall element 4. The holding pin 3 comprises a bearing member 31 with a spacing member 31*a* whereby an intermediate space is defined which can accommodate a not particularly illustrated intermediate element 5 which may constitute, for example, a flat solid display object, insulating material or the like.

In the fourth embodiment shown in FIG. 4 the leg 21 of the holding clamp 2 is secured by means of a holding pin 3 comprising a bearing member 31 sunk in the rear wall 4 and a snap-type closure 35 comprising a female snap-fastening element 35*a* which cooperates with a male snap-fastening element 33*a* formed at the holding pin 3. The snap-type closure thus comprises two form-lockingly interconnectable fastening or securing elements producing a force-locking connection between the leg 21 of the holding clamp 2 and the rear wall element 4.

Figure 5:
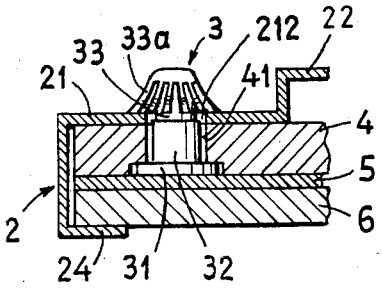
FIG. 5 is a sectional partial view of a fifth embodiment of the inventive holding fixture.

In FIG. 5 there is shown in section part of a fifth embodiment of the inventive holding fixture 1 with a holding member 33 which comprises a securing element 33*a*. This securing element 33*a* ensures the necessary force-locking connection and yet practically does not provide any resistance during the through-passage of the holding pin 3 through the opening 41 and the congruent aperture 212 in the leg 21 of the holding clamp 2. After the through-passage the securing element 33*a* opens up in a cross-section enlarging manner, for example, approximately like an umbrella and blocks any withdrawal.

Figure 6:
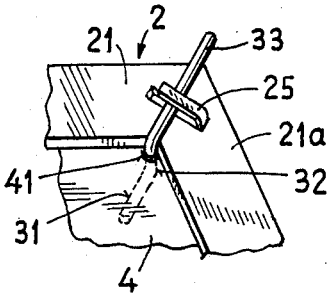
FIG. 6 is a perspective partial view of a sixth embodiment of the inventive holding fixture.

Finally, FIG. 6 shows in an oblique view part of a sixth embodiment of the inventive holding fixture 1 containing a holding pin 3 with a bearing member 31 and a through-pass member 32 arranged at right angles thereto. A holding member 33 of the holding pin 3 practically constitutes only a bendable or flexible extension of the through-pass member 32. After this has been passed through the opening 41 of the rear wall element 4 and, for the purpose of securing, the bent flexible extension can be hung into a position securing element constituting a bent-open strap 25 provided at the holding clamp 2. In order to produce a force-locking connection, the holding pin 3 is simply bent over the legs 21 and 21*a* of the holding clamp 2 and thus presses these legs to the rear side of the rear wall element 4 in a positionally stable manner. In the assembled condition the holding pin 3 of this embodiment assumes substantially a stepped shape. With respect to the remaining components, this sixth embodiment corresponds to the afore-described embodiments and, therefore, such remaining components do not require a separate and specific illustration and description.

While there are shown and described present preferred embodiments of the invention, it is to be distinctly understood that the invention is not limited thereto, but may be otherwise variously embodied and practiced within the scope of the following claims.

What I claim is:

1. A holding fixture releasably interconnecting at least two wall elements comprising at least a rear wall element having an opening and a front wall element, comprising:

at least one holding clamp comprising a projection grippingly extending around the margins at least of said rear wall element and said front wall element at a predetermined location of such wall elements in the operational position of said at least one holding clamp;

said at least one holding clamp, in the operational position thereof, extending substantially parallel to said rear wall element and at least partially engaging said rear wall element on a rear side thereof;

connecting means releasably and substantially force-lockingly connecting said at least one holding clamp with a rear side of said rear wall element in the operational position of said at least one holding clamp;

said connecting means comprising a holding pin which, in its operational position, traverses said opening of said rear wall element;

said holding pin comprising:

a bearing member;

a through-pass member extending away from said bearing member substantially at right angles thereto and passing through said opening in said rear wall element in said operational position of said holding pin;

a holding member following said through-pass member; and said holding member, in said operational position of said holding pin, protruding above and being engageable with said holding clamp in said operational position of said holding pin.

2. The holding fixture as defined in claim 1, wherein:

said connecting means further comprise securing means; and said securing means being provided at said holding member of said holding pin for force-lockingly connecting said at least one holding clamp to said rear side of said rear wall element in said operational position of said holding pin.

3. The holding fixture as defined in claim 2, wherein:

said securing means constitute two form-lockingly interconnectable securing elements; and said two form-lockingly interconnectable securing elements being form-lockingly interconnectable in said operational position of said holding pin.

4. The holding fixture as defined in claim 1, further including:

a mounting piece;

said mounting piece, in the operational position of said holding fixture, being arranged between said at least one holding clamp and said holding member of said holding pin in said operational position of said holding pin;

said connecting means further comprising securing means; and said securing means force-lockingly connecting said mounting piece and said at least one holding clamp to said rear side of said rear wall element in said operational position of said holding pin.

5. The holding fixture as defined in claim 3, wherein:

said at least one holding clamp contains an aperture substantially aligned with said opening of said rear wall element in the operational position of said at least one holding clamp and permitting through-passage of said holding pin in its operational position;

said holding pin, in the operational position thereof, extending through said opening in said rear wall element and through said aperture in said at least one holding clamp; and said two form-lockingly interconnectable securing elements of said securing means constituting a thread member provided at said holding member of said holding pin and a nut threadably engageable with said thread member provided at said holding pin.

6. The holding fixture as defined in claim 3, wherein:

said at least one holding clamp contains an aperture substantially aligned with said opening of said rear wall element in the operational state of said at least one holding clamp and permitting through-passage of said holding pin in its operational position;

said holding pin, in the operational position thereof, extending through said opening in said rear wall element and through said aperture in said at least one holding clamp; and said two form-lockingly interconnectable securing elements of said securing means constituting two snap-fastening elements interconnectable in the manner of a snap-type closure.

7. The holding fixture as defined in claim 2, wherein:

said at least one holding clamp contains an aperture substantially aligned with said opening of said rear wall element in the operational position of said at least one holding clamp and permitting through-passage of said holding pin in its operational position;

said securing means constituting a single securing element;

said single securing element being provided at said holding member of said holding pin; and said single securing element, after the through-pass member of said holding pin has been passed through said opening in said rear wall element and through said aperture in said at least one holding clamp, grippingly extending over and acting upon said at least one holding clamp.

8. The holding fixture as defined in claim 1, wherein:

said holding member of said holding pin constitutes a bendable extension of said through-pass member of said holding pin;

said bendable extension, in said operational position of said holding pin, being bendable in such a manner that the bendable extension extends at said at least one holding clamp; and securing means acting upon said bent bendable extension in said operational position of said holding pin in order to hold the bent bendable extension in position in said holding clamp.

9. The holding fixture as defined in claim 8, wherein:

said securing means constitute a securing element mounted at said at least one holding clamp for securing in a single predetermined position said bendable extension.

10. The holding fixture as defined in claim 1, wherein:

said bearing member of said holding pin is receivable, in the operational position of said holding pin, in a recess formed on the front side and in the region of said through-pass opening of said rear wall element.

11. The holding fixture as defined in claim 1, wherein:

said bearing member of said holding pin is engageable with a rear side of said front wall element in the operational position of said holding pin.

12. The holding fixture as defined in claim 11, wherein:

said holding pin further comprises a spacing member; and said spacing member being engageable to said front side of said rear wall element in said operational position of said holding pin.

13. The holding fixture as defined in claim 1, wherein:

said at least one holding clamp, in said operational position of said holding pin, engages said through-pass member of said holding pin in the region of said opening of said rear wall element.

14. The holding fixture as defined in claim 13, wherein:

said connecting means further comprise securing means; and said securing means being provided at said holding member of said holding pin for force-lockingly connecting said at least one holding clamp to said rear side of said rear wall element in said operational position of said holding pin.

15. The holding fixture as defined in claim 14, wherein:

said securing means constitute a single securing element;

said single securing element being provided at said holding member of said holding pin for force-lockingly connecting said at least one holding clamp to said rear side of said rear wall element in said operational position of said holding pin.

16. The holding fixture as defined in claim 15, wherein:

said single securing element constitutes an enlargement formed at said holding member of said holding pin; and said at least one holding clamp being force-lockingly connectable between said enlargement of said holding member and said through-pass member of said holding pin in the operational position of said holding pin.

17. The holding fixture as defined in claim 15, further including:

a mounting piece arranged on a side of said at least one holding clamp which is remote from said rear side of said rear wall element;

said single securing element constituting an enlargement formed at said holding member of said holding pin; and said mounting piece and said at least one holding clamp being force-lockingly connectable between said enlargement of said holding member and said through-pass member of said holding pin in the operational position of said holding pin.

18. The holding fixture as defined in claim 1, wherein:

said at least one holding clamp comprises two legs which form a predetermined angle therebetween; and each said leg of said at least one holding clamp comprising a projection grippingly extendable around said margins at least of said rear wall element and of said front wall element at a predetermined location of such wall elements in said operational position of said at least one holding clamp.

19. The holding fixture as defined in claim 18, wherein:

said two legs of said at least one holding clamp form a right angle therebetween.

20. The holding fixture as defined in claim 18, wherein:

said two legs of said at least one holding clamp define related inner edges;

said inner edges forming therebetween said predetermined angle and facing each other;

said inner edges merging at a predetermined merger location; and said merger location of said inner edges of said two legs of said at least one holding clamp being substantially aligned with said opening of said rear wall element in said operational position of said at least one holding clamp.

21. The holding fixture as defined in claim 1, wherein:

said at least one holding clamp further comprises at least one spacing region; and said spacing region being elevated relative to said rear side of said rear wall element in the operational position of said at least one holding clamp.

22. The holding fixture as defined in claim 21, wherein:

said at least one spacing region of said at least one holding clamp is provided with an aperture.

23. The holding fixture as defined in claim 1, wherein:

said at least one holding clamp releasably and force-lockingly interconnects, in the operational position thereof, said rear wall element and said front wall element and an intermediate element arranged between said rear wall element and said front wall element.

24. The holding fixture as defined in claim 1, wherein:

said at least one holding clamp releasably and force-lockingly interconnects, in the operational position thereof, said rear wall element, a front wall element formed of a transparent material, and an intermediate element arranged between said rear wall element and said transparent front wall element and constituted by at least one flat display object.

* * * * *